United States Patent [19]

D'Amato

[11] 3,939,447

[45] Feb. 17, 1976

[54] SPRING MOUNT FOR A CATHODE RAY TUBE YOKE

[75] Inventor: Ralph James D'Amato, Lancaster, Pa.

[73] Assignee: RCA Corporation, New York, N.Y.

[22] Filed: Jan. 7, 1975

[21] Appl. No.: 539,107

[52] U.S. Cl. ..... 335/210; 178/7.81

[51] Int. Cl.[2] ..... H01F 7/00

[58] Field of Search ..... 178/7.8, 7.81; 335/210

[56] References Cited

UNITED STATES PATENTS

| | | | |
|---|---|---|---|
| 3,629,751 | 12/1971 | Massa | 335/210 |
| 3,637,930 | 1/1972 | Meier | 335/210 X |
| 3,697,909 | 10/1972 | Christensen et al. | 335/210 |
| 3,781,730 | 12/1973 | Salners | 335/210 |

*Primary Examiner*—G. Harris

*Attorney, Agent, or Firm*—Glenn H. Bruestle; Dennis H. Irlbeck

[57] ABSTRACT

The mount includes a plurality of springs interconnecting a yoke to a cathode-ray tube. The springs may be formed on a yoke housing and connected to a platform attached to the tube or connected directly to the tube. Alternately, the springs may be formed in the platform connected to the yoke housing.

5 Claims, 13 Drawing Figures

SPRING MOUNT FOR A CATHODE RAY TUBE YOKE

BACKGROUND OF THE INVENTION

This invention relates to means for mounting a magnetic deflection yoke on the neck of a cathode-ray tube and particularly to an adjustable mount utilizing a plurality of springs.

Cathode-ray tubes, such as color television picture tubes, require a magnetic-deflection yoke mounted on the outside of the tube envelope. The yoke comprises horizontal and vertical deflection coils together with a suitable core. During operation of the tube, the yoke field deflects electron beams within the tube in both the vertical and horizontal directions thereby causing the beams to scan the viewing screen of the tube.

Several structures have been proposed for mounting and holding the yoke in a desired position on the tube. In one structure, the yoke is placed in a housing which is in turn positioned and glued to the tube. In another structure, the housing is clamped on the tube and the yoke is positioned within the housing and clamped in place. In a third structure, first a platform is glued to the outside of the tube and then the yoke and housing are positioned over the tube and clamped to the platform. An improved structure is presented in U.S. Pat. No. 3,786,185 issued to T. M. Shrader on Jan. 15, 1974. This patent discloses a combination including a platform affixed to a cathode-ray tube by an adhesive and a yoke housing enclosing a portion of the yoke. The platform has a plurality of projections which are secured (e.g. gluing) within indentations in the housing.

Although this later yoke mount provides adequate mounting means for permanently affixing a yoke to a tube, it is desirable to further simlify the construction of such mounts.

SUMMARY OF THE INVENTION

A yoke mount for a cathode-ray tube comprises a plurality of springs interconnecting and supporting the yoke in spaced relationship to the tube. The mount permits universal alignment of the yoke relative to the tube prior to interconnection of the springs to the tube and after interconnection provides immobilization of the yoke.

DESCRIPTION OF THE PREFERRED EMBODIMENTS

Figure 1:
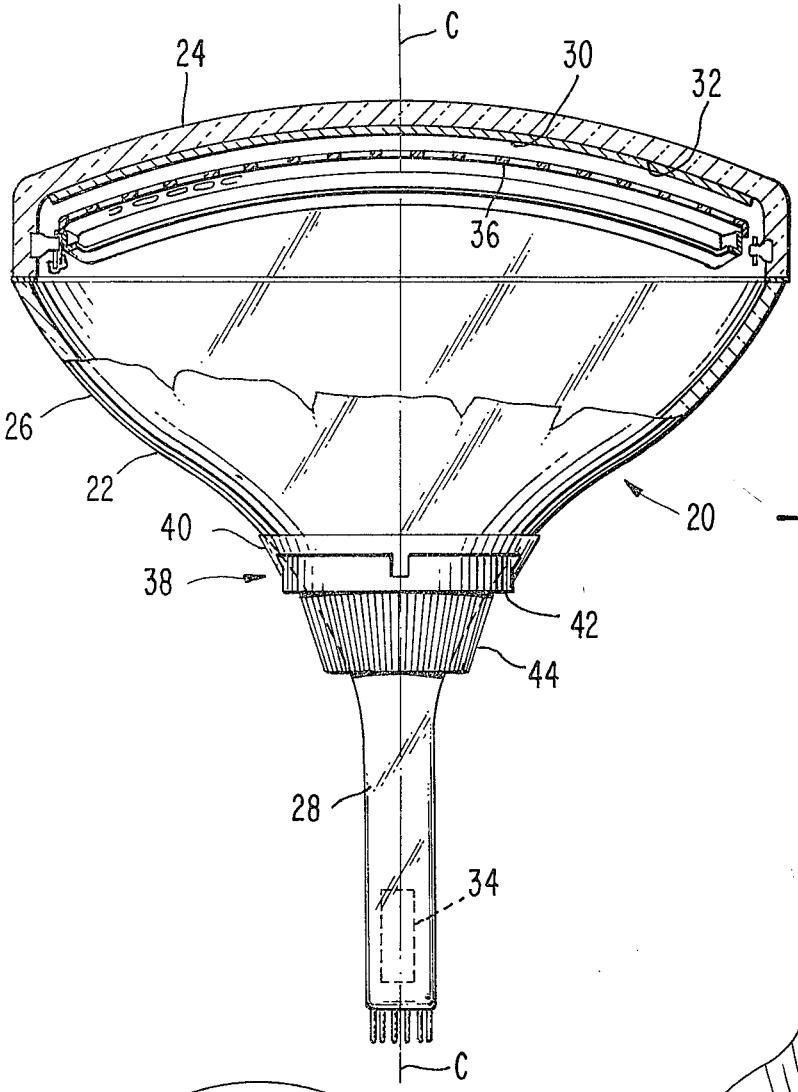
FIG. 1 is a partially cutaway side elevational view of a cathode-ray tube.
Figure 3:
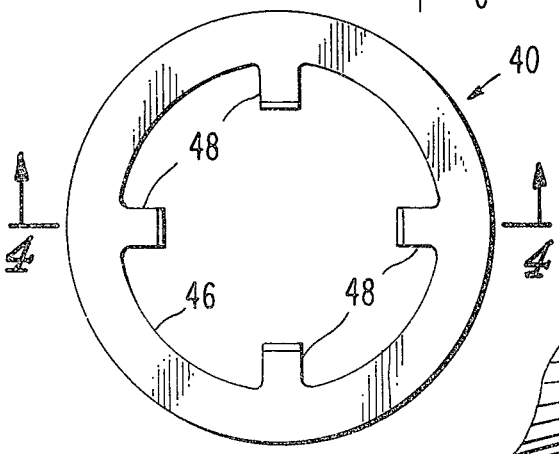
FIG. 3 is a top plan view of a platform of the yoke mount of FIG. 2.
Figure 2:
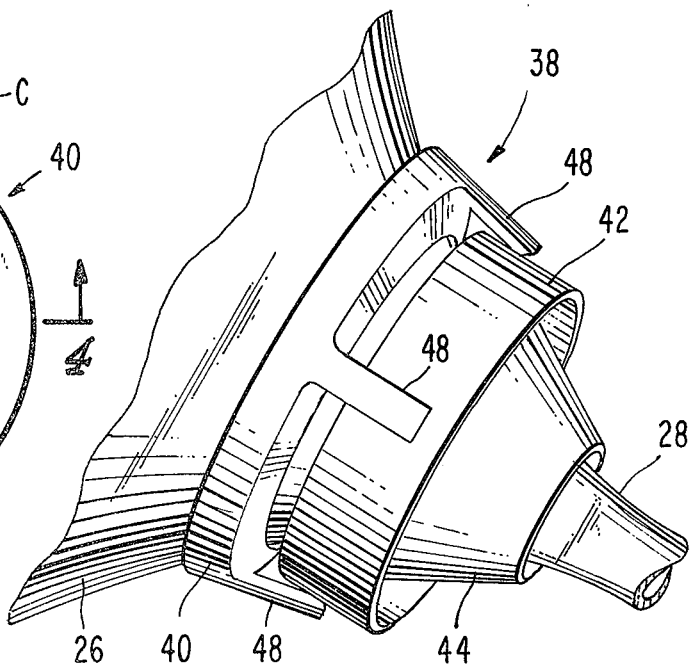
FIG. 2 is a perspective view of a portion of the cathode-ray tube of FIG. 1 showing a yoke mount in greater detail.
Figure 4:
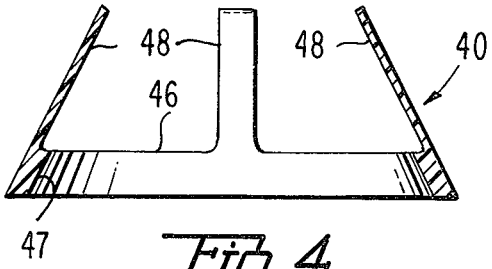
FIG. 4 is a sectional side view of the platform taken at line 4—4 of FIG. 3.
Figure 5:
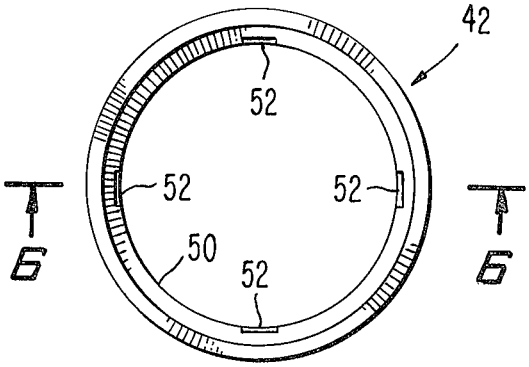
FIG. 5 is a top plan view of a housing of the yoke mount of FIG. 2.
Figure 6:
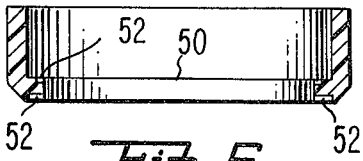
FIG. 6 is a sectional side view of the housing taken at line 6—6 of FIG. 5.
Figure 7:
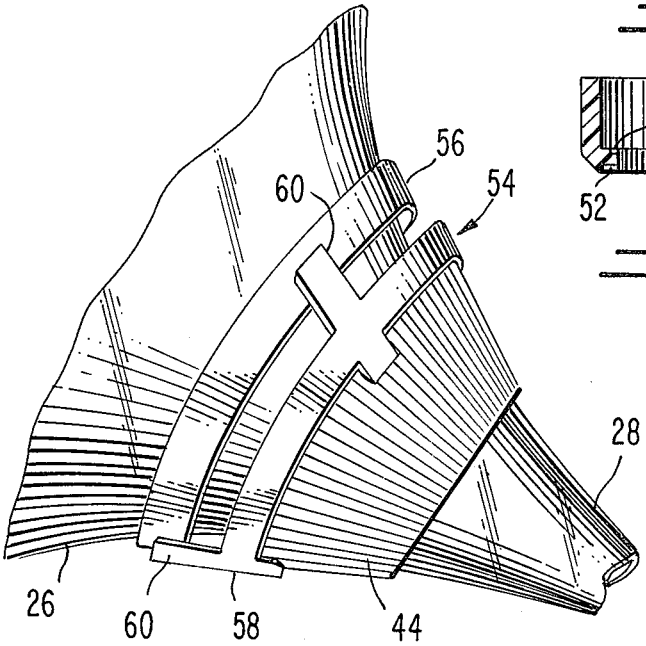
FIG. 7 is a perspective view of a portion of a cathode-ray tube having a second yoke mount embodiment thereon.
Figure 8:
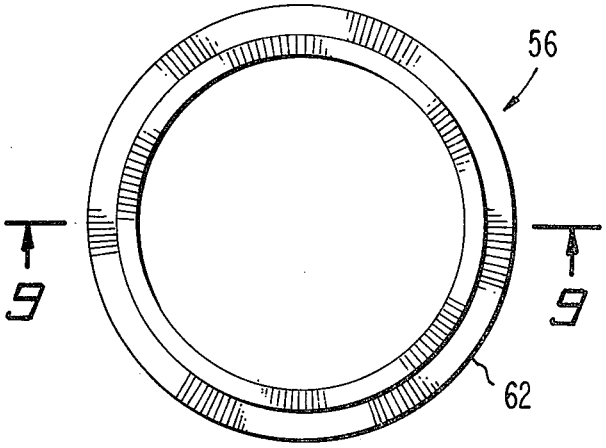
FIG. 8 is a top plan view of a platform of the second yoke mount embodiment of FIG. 7.
Figure 9:
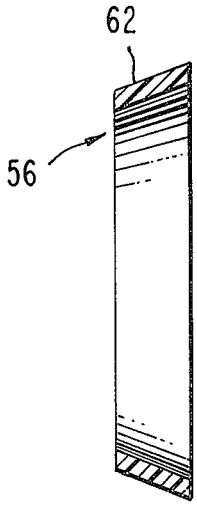
FIG. 9 is a sectional side view of the platform taken at line 9—9 of FIG. 8.
Figure 10:
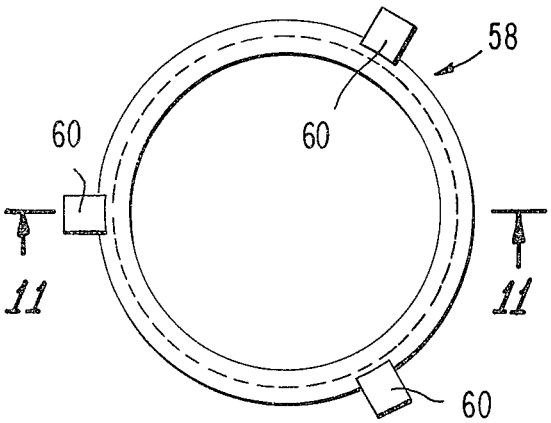
FIG. 10 is a top plan view of a housing of the second yoke mounting embodiment of FIG. 7.
Figure 11:
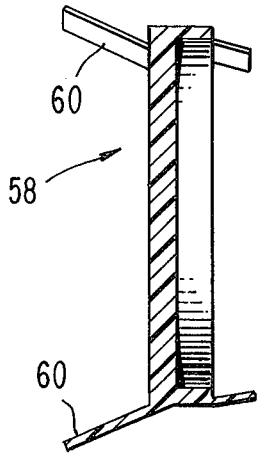
FIG. 11 is a sectional side view of the housing taken at line 11—11 of FIG. 10.

FIG. 1 illustrates a color television picture tube 20 of the apertured-mask type comprising an evacuated glass envelope 22. The envelope 22 includes a faceplate panel 24, a funnel 26 and a neck 28. A three-color emitting phosphor viewing screen 30 is supported on the inner surface 32 of the faceplate panel 24. A preferred viewing screen 30 is of a known line type. An electron gun assembly 34 positioned in the neck 28 includes three electron guns (not shown) one for each of the three color phosphors on the viewing screen 30. An apertured mask 36 is positioned in the envelope 22 adjacent the viewing screen 30. The apertured mask 36, used with the line type viewing screen 30, includes slot-shaped apertures. The electron gun assembly 34 is adapted to project three electron beams toward the faceplate panel 24 through the apertured mask 36 to strike the viewing screen 30. The preferred electron-gun assembly 34 is of an inline type, that is, a type which projects a plurality of electron beams from a common plane toward the screen 30.

Attached to the outside of the tube 20 is a yoke mount 38 comprising a platform 40 and a yoke housing 42. The platform 40 is permanently fixed to the outside surface of the funnel 26, and the housing 42, shown with a yoke 44 mounted thereon, is positioned on the platform 40 near the intersection of the funnel 26 and neck 28. A preferred yoke 44 is comprised of two pairs of opposed magnetic field producing coils (not shown) having toroidal windings. The housing 42 with the yoke 44 thereon is mounted on the platform 40, as will be described.

The platform 40 comprises an annular ring 46 having an inside surface 47 that substantially conforms to the shape of the funnel to which it might be attached. In the present embodiment, four spaced springs 48 extend in a cantilevered-fashion toward a common point from the outer periphery of the ring 46. The circular area within the unbent springs 48 is smaller than the outer diameter of the housing 42 so that the springs 48 must be bent outwardly to accomodate the housing 42. Such construction ensures that the ends of the springs 48 will always contact the housing 42 regardless of movement of the housing 42 relative to the platform during yoke alignment.

In order to facilitate attachment to a tube, the inner surface 47 of the annular ring 46 may have a plurality of recesses (not shown) therein for receiving a suitable adhesive material. Preferably, a hot-melt thermoplastic, such as the following may be used for the adhesive.

| Material Designation | Marketed By | Melting Temperature |
|---|---|---|
| Versalon 1300 | General Mills Chemical Co., | 92°C. |

-continued

| Material Designation | Marketed By | Melting Temperature |
|---|---|---|
| | Minneapolis, Minn. | |
| Versalon 1138 | " | 125°C. |
| Versalon 1165 | " | 134°C. |
| Resyln 34-2927 | National Starch and Chemical Corp., New York, N.Y. | 58°C. |

The housing 42 is cylindrically shaped and includes an annular inner ledge 50 with indentations 52 therein to facilitate attachment of a yoke by clips (not shown), gluing or ultrasonic welding.

The mount 38 is assembled by first attaching the platform 40 to the tube 20. The position of this platform 40 is not critical but it must be positioned within reasonable tolerances to permit full motion of the housing 42 during adjustment of the yoke 44.

Separate from the tube 20, the yoke 44 is mounted in the housing 42. The housing 42 and yoke 44 are next placed within the springs 48 of the platform 40, and the yoke 44 and tube 20 are operated. The yoke 44 and housing 42 are then positioned so that yoke 44 is aligned with the electron beams within the tube 20. Once the correct alignment is achieved, the springs 48 are attached to the housing 42 by suitable means, such as by gluing, mechanically fastening or by ultrasonic welding. It should be noted that only the housing is movable before welding and that the point on each spring 48 that contacts the housing 42 will always be the same. Therefore, an ultrasonic welding step can be easily performed by a fixed four headed ultrasonic welding device. Such device is desirable over hand held welding devices which may not always produce a repeatable weld.

A second embodiment of the present invention is shown in FIGS. 7 through 11. This second mount 54 is much like the one previously described except that springs 60 are formed on the mount housing 58 instead of on the mount platform 56. In this embodiment, the platform 56 is a simple hollow truncated cone 62 and the housing 58 is modified to include three springs 60 extending outwardly therefrom in cantilever-fashion.

Assembly of this second mount 54 is similar to that of the first mount 38 except that, when used, ultrasonic welding heads will remain fixed relative to an edge of the platform 56 to account for variable locations of the springs. In this embodiment, the springs 60 keep pressure on the platform 56 while the housing 58 is being adjusted.

In both of the foregoing mount embodiments, once the springs are attached to either the housing or platform, the assembled mount permanently maintains the position of the yoke relative to the tube.

Figure 12:
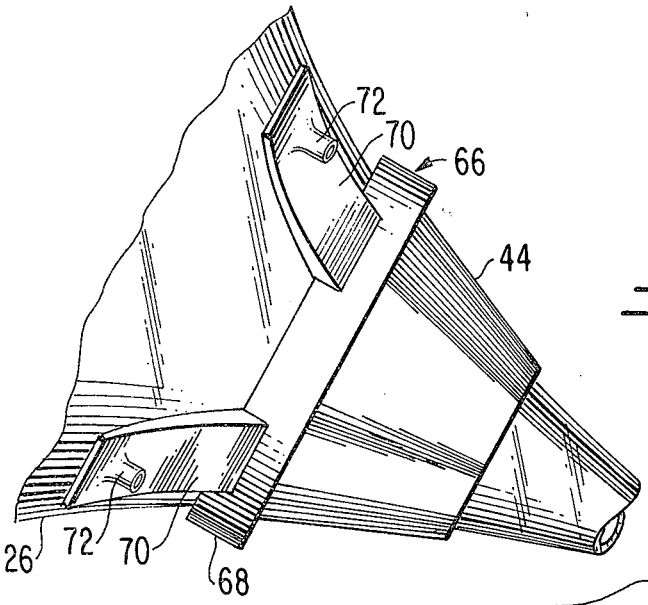
FIGS. 12 and 13 are respective perspective and plan views of a portion of a cathode-ray tube having a third yoke mount embodiment thereon.
Figure 13:
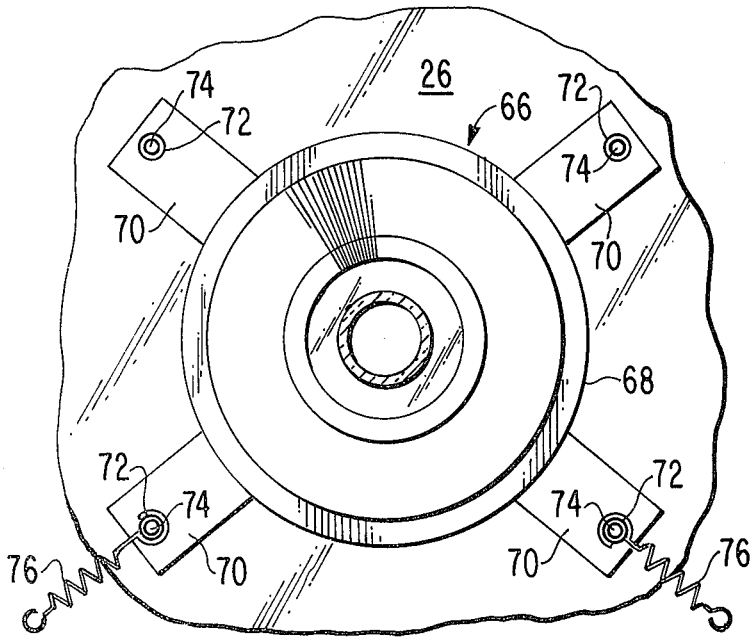

A third mount embodiment of the present invention that eliminates the need for a separate platform is shown in FIGS. 12 and 13. In this mount 66, a yoke housing 68 includes four cantilever springs 70 extending therefrom into direct contact with the tube funnel

26. Each spring 70 has a hollow post 72 thereon. The centers of these posts 72 provide conduits 74 for the insertion of an adhesive once the yoke 44 is properly aligned with the tube.

In attaching the mount 66 to the tube, the mount 66 is placed against the funnel 26 so that the springs 70 are slightly bent. Thereafter, the mount 66 can be moved universally in any direction until the yoke 44 is aligned with electron beams within the tube. Once the mount 66 is properly positioned, adhesives are inserted through the conduits 74 to affix the springs 70 and mount 66 to the tube. Since the springs 70 may be under some strain when attached, auxilliary coil springs 76 may be attached between the posts 72 and tube mounting means (not shown) to minimize any shearing force between the springs 70 and the tube funnel 26 caused by the pressure of the springs 70.

The material for the foregoing embodiments may be any nonconductive material that can be formed with sufficient strength. Various plastics may be used for both the platforms and housings. However, because of the heat encountered in an operational tube, a material should be selected that will not deform substantially with increased temperature. Materials that have been found suitable for this purpose are manufactured by the G. E. Corporation under the brand names Lexan 2014 and Noryl SEO-225.

I claim:

1. A yoke mount for a cathode-ray tube comprising,
a first portion adapted for receiving a yoke,
a second portion adapted for connection to a cathode-ray tube, and
a plurality of springs interconnecting said first and second portions, said springs providing the sole support of said first portion relative to said second portion, said springs being bendable to accomodate alignment of a yoke with a cathode-ray tube.

2. The yoke mount as defined in claim 1 wherein,
said second portion comprises an annular platform having an inner surface conforming to a portion of a cathode-ray tube and includes said plurality of springs cantilevered therefrom, and
said first portion comprises a housing including means for mounting a yoke thereon, said housing being attached to free ends of said springs.

3. The yoke mount as defined in claim 2, wherein said housing is connected to said springs by ultrasonic welds.

4. The yoke mount as defined in claim 1 wherein,
said second portion comprises an annular platform having an inner surface conforming to a portion of a cathode-ray tube, and
said first portion comprises a housing including means for mounting a yoke thereon, said housing including said plurality of springs cantilevered therefrom into contact with and attachment to said platform.

5. The yoke mount as defined in claim 4, wherein free ends of said cantilevered springs are connected to said platform by ultrasonic welds.

* * * * *